United States Patent [19]

Kabai et al.

[11] Patent Number: 5,038,826

[45] Date of Patent: Aug. 13, 1991

[54] THREE-WAY ELECTROMAGNETIC VALVE

[75] Inventors: Koichi Kabai, Anjo; Katsuyuki Tamai, Kariya, both of Japan

[73] Assignee: Nippondenso Co., Ltd., Kariya, Japan

[21] Appl. No.: 428,297

[22] Filed: Oct. 26, 1989

[30] Foreign Application Priority Data

Oct. 27, 1988 [JP] Japan ..... 63-271870
Sep. 11, 1989 [JP] Japan ..... 01-235471

[51] Int. Cl.[5] ..... F15B 13/044
[52] U.S. Cl. ..... 137/625.65; 137/625.25
[58] Field of Search ..... 137/625.25, 625.65

[56] References Cited

U.S. PATENT DOCUMENTS 3,680,782 8/1972 Monpetit et al. .
4,545,352 10/1985 Jourde et al. .
4,719,889 1/1988 Amann et al. .
4,753,212 6/1988 Miyaki et al. .
4,777,921 10/1988 Miyaki et al. .
4,784,101 11/1988 Iwanaga et al. .
4,928,887 5/1990 Miettaux .

FOREIGN PATENT DOCUMENTS 0319371 6/1989 European Pat. Off. .
2051944 5/1971 Fed. Rep. of Germany .
2920702 11/1980 Fed. Rep. of Germany .
8529255 10/1985 Fed. Rep. of Germany .
59-165858 9/1984 Japan .

*Primary Examiner*—Gerald A. Michalsky
*Attorney, Agent, or Firm*—Cushman, Darby & Cushman

[57] ABSTRACT

A three-way electromagnetic valve provided with a valve body, a movable member slidably disposed in the valve body, an actuator for driving the movable member, an opening-closing mechanism provided in an internal passage formed in the movable member. A clearance reducing portion is formed to reduce a gap created by a pressurized fluid entering the slide section or by the force of fastening and fixing the valve body, thereby limiting the leakage of the pressurized fluid.

23 Claims, 16 Drawing Sheets

DEFORMATION OF SLIDE BORE OF VALVE BODY 2 AT INTERNAL PRESSURE OF 100 MPa $\varepsilon_1$: CLEARANCE AT SLIDE SECTION INLET $\varepsilon_2$: CLEARANCE AT SLIDE SECTION OUTLET EXTENT OF DEFORMATION OF VALVE BODY SLIDE BORE AT INTERNAL PRESSURE OF 100 MPa DEPENDING UPON EXISTENCE OF ANNULAR GROOVE 61

THREE-WAY ELECTROMAGNETIC VALVE

BACKGROUND OF THE INVENTION

This invention relates to a three-way electromagnetic valve suitable for use in a system for controlling a high pressure fluid, for example, a diesel fuel injection system.

In a diesel engine fuel injection system such as the one disclosed in Japanese Patent Laid-Open No. 59-165858, a three-way electromagnetic valve is used to control the injection timing and the injection rate. This three-way electromagnetic valve operates in such a manner that a fuel supplied at a high pressure from a pressure fuel feed pump is led from a fuel passage to a supply port and is supplied to a chamber formed in a moving piston and to a control port via an annular recess and a plurality of fuel passages formed in the moving piston and communicating with the recess.

A high pressure is applied to the valve body at the annular recess outward in the radial direction by the effect of the high pressure fuel led to the recess, thereby increasing the clearance of the slide section formed between the slide bore and the moving piston. The high pressure fuel therefore leaks and enters the increased clearance and presses not only the recess 8 but also the whole of the bore wall, and further increases the clearances of upper and lower slide sections defined above and below the annular recess, resulting in an increase in the leakage of the high pressure fuel.

A solenoid, the valve body and a control chamber are integrally fixed by fastening to construct the three-way valve while maintaining the desired pressure at which contact surfaces of the valve body and the control chamber are pressed against each other. Since in this construction a spacer in the form of a ring is interposed between the solenoid and the valve body, the fastening force acts toward the outer periphery of the valve body at the upper surface thereof and causes the bore edge of the slide bore to be deformed outward. The clearances of the slide sections between the slide bore and the moving piston are thereby increased toward the bore edge, resulting in a further increase in the leakage of the high pressure fuel.

As described above, if the clearances of the slide sections are increased, the leakage of the high pressure liquid through these clearances becomes large. This three-way electromagnetic valve therefore entails the problem of loss of the driving torque of the pressure fuel feed pump, the problem of a reduction in the fuel injection pressure, and so on.

SUMMARY OF THE INVENTION

It is an object of the present invention to prevent the clearance between the slide portions from increasing and to thereby limit the leakage.

To achieve this object, according to the present invention, there is provided a three-way electromagnetic valve including: a valve body having a supply port through which a pressurized fluid flows, a control port, a discharge port, a slide bore formed with the ports so as to communicate with the same, and a valve seat formed between the supply port and the discharge port; a movable member slidably disposed in the slide bore and capable of contacting and moving away from the valve seat, the movable member having an internal passage for communication between the supply port and the control port, the movable member providing communication between the control port and the discharge port when not seated on the valve seat; an actuator for driving the movable member; an opening-closing means disposed in the internal passage of the movable member, operated to open the internal passage when the movable member is seated on the valve seat and operated to close the internal passage when the movable member is not seated on the valve seat; and a reduction means for reducing a gap formed between the slide bore and the outer peripheral surface of the movable member when the movable member is seated on the valve seat

BRIEF DESCRIPTION OF THE DRAWINGS

FIG. 1 is a cross-sectional view;

FIG. 2 is a cross-sectional view of a modification of the first embodiment;

FIG. 3 is a diagram of of the extent of deformation;

FIG. 4 is a cross-sectional view;

FIG. 5 is a cross-sectional view taken along the line V—V of FIG. 4;

FIG. 6 is a diagram of a state of application of pressures;

FIG. 7 is a graph showing reductions in the leakage;

FIGS. 8 to 10B show a third embodiment of the present invention;

FIG. 8 is a cross-sectional view;

FIG. 9 is a cross-sectional view taken along the line IX—IX of FIG. 8;

FIGS. 10A and 10B are diagrams of the extents of deformations;

FIG. 10A relates to a case of the conventional valve where no pressure accumulating chamber is provided;

FIG. 10B relates to the case of the present invention where a pressure accumulating chamber is provided;

FIGS. 11 to 16 show a fourth embodiment of the present invention;

FIG. 11 is a cross-sectional view;

FIG. 12 is a diagram illustrating the shape of a recess and the shape of a bit;

FIG. 13 is a diagram of a state of application of inward and outward pressures;

FIG. 14 is a diagram of comparison between the extents of deformations of slide sections depending upon the existence of an extension 51;

FIGS. 16 to 19 show a fifth embodiment of the present invention;

FIG. 16 is a cross-sectional view;

FIG. 17 is a cross-sectional view of essential portions;

FIG. 18 is a diagram of comparison between the extents of deformations of slide sections depending upon the existence of an annular groove 61;

FIG. 19 is a graph showing the relationship between the depth $L_3$ of the annular groove and the leakage.

DESCRIPTION OF THE PREFERRED EMBODIMENTS

Preferred embodiments of the present invention will be described below together with the conventional art with reference to the accompanying drawings.

In the diesel engine fuel injection system disclosed in Japanese Patent Laid-Open No. 59-165858, a three-way electromagnetic valve is used to control the injection timing and the injection rate. This electromagnetic valve has a structure such as that illustrated in FIG. 20.

Figure 20:
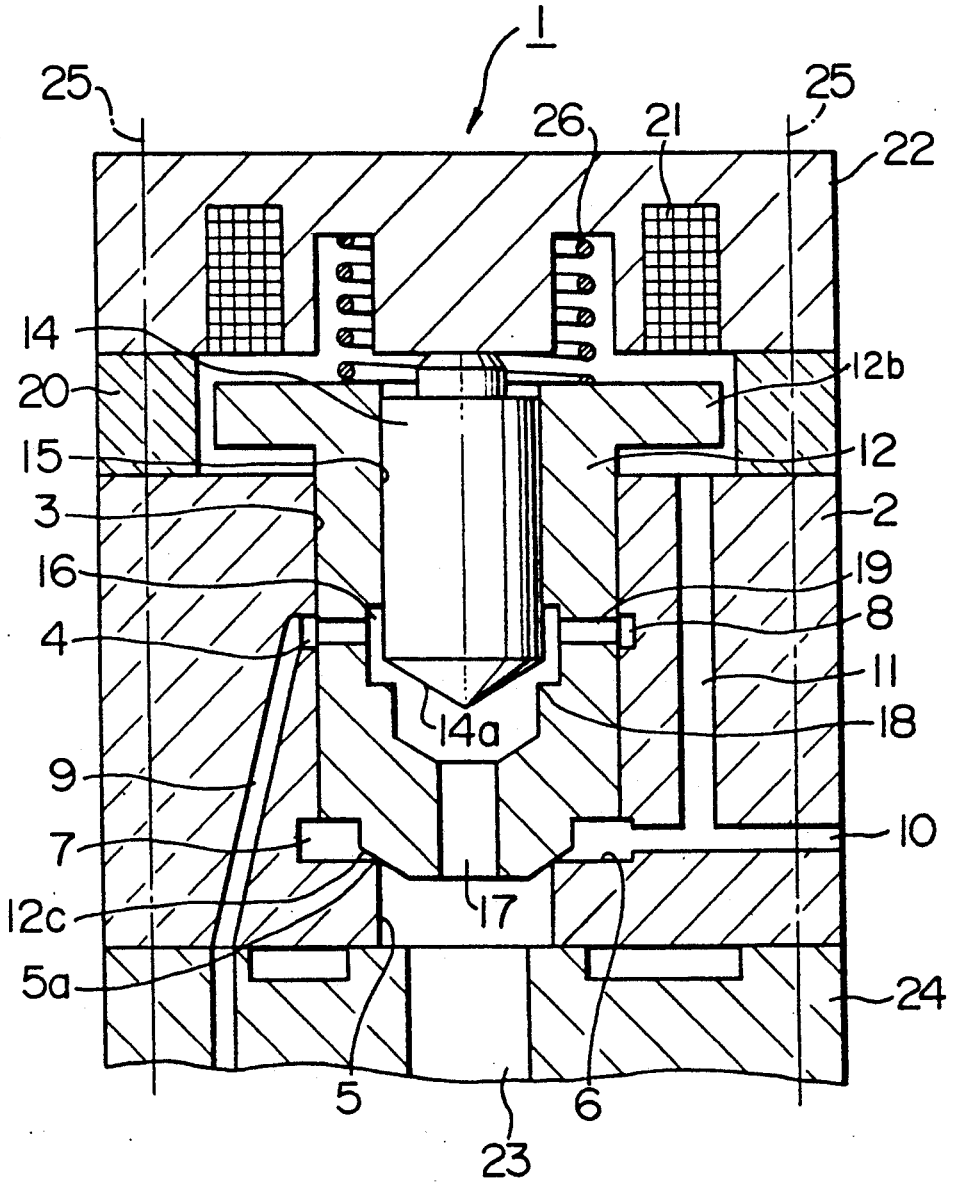
F I G. 20 PRIOR ART
FIG. 20 is a cross-sectional view of a conventional three-way electromagnetic valve.

Referring to FIG. 20, a slide bore 3 is formed in a valve body 2 of the three-way electromagnetic valve 1 at the center thereof. A supply port 4 through which a high pressure fuel which is a pressurized fluid is supplied is formed in a portion of the bore wall defining the slide bore 3. A control port 5 and a discharge port 6 are also formed in the valve body 2; the control port 5 opens into the slide bore 3 in the direction of the axis thereof, and the discharge port 6 laterally opens into the slide bore 3. A chamber 7 is formed between the ports 5 and 6. In the valve body 2 are also formed an annular recess 8 which communicates with the supply port 4 and an inlet passage 9 through which the high pressure fuel is introduced into the supply port 4. A discharge passage 10 is formed so as to extend from the discharge port 6. One end of a branch passage 11 branching off at the other end from the discharge passage 10 opens in an upper surface of the valve body 2.

A moving piston 12 is slidably disposed in the slide bore 3. The moving piston 12 has a poppet portion 12*a* which is formed at its one end and which can be brought into contact with and moved apart from a valve seat 5*a* formed at an edge of the control port 5. The moving piston 12 also has an armature 12*b* formed at its other end so as to face a later-mentioned electromagnetic coil 21. A fitting bore 15 in which a free piston 14 is fitted is formed in the moving piston 12. A chamber 16 is formed continuously with the fitting bore 15. The fitting bore 15 communicates with the control port 5 via the chamber 16 and a passage 17. A valve seat 18 is formed between the chamber 16 and the passage 17. A poppet portion 14*a* of the free piston 14 can be brought into contact with and moved apart from the valve seat 18. A plurality of fuel passages 19 for introducing the high pressure fuel into the chamber 16 are formed in the moving piston 12 while being arranged in the circumferential direction at equal angular intervals at positions corresponding to the annular recess 8 formed in the slide bore 3.

The valve body 2 is integrally and fixedly connected by fastening with fastening bolts 25 or the like to a solenoid 22 in which the electromagnetic coil 21 is wound and to a control chamber 24 having a passage 23 communicating with the control port 5, with a spacer 20 in the form of a ring being interposed between the solenoid 22 and the valve body 2, thus constructing the three-way electromagnetic valve 1. A spring 26 is set between the solenoid 22 and the moving piston 12 to press the poppet portion 12 a of the moving piston 12 against the valve seat 5*a*.

The thus-constructed conventional three-way electromagnetic valve 1 operates as described below. As is well known, two states of the valve are alternately established:

one in which the moving piston 12 is moved upward by energizing the electromagnetic coil 21 to provide communication between the control port 5 and the discharge port 6, while the poppet portion 14*a* of the free piston 14 is seated on the valve seat 18 to stop supplying the high pressure fuel from the supply port 4 to the control port 5; and one in which the electromagnetic coil 21 is not energized, the moving coil 12 is moved downward and seated on the valve seat 5*a* to stop communication between the control port 5 and the discharge port 6, and the free piston 14 is moved apart from the valve seat 18 to provide communication between the supply port 4 and the control port 5, thereby supplying the high pressure fuel to the control chamber 24.

In the three-way electromagnetic valve 1 based on the above-described construction and operation, the fuel supplied from the pressure fuel feed pump at a high pressure is introduced into the supply port 4 via the fuel passage 9 and is supplied to the chamber 16 and to the control port 5 via the annular recess 8 and the plurality of fuel passages 19 communicating with the recess 8.

The high pressure fuel introduced into the annular recess 8 applies a high pressure to the valve body 2 at the recess 8 outward in the radial direction so that the valve body 2 is deformed outward, thereby increasing the clearances of slide sections between the slide bore 3 and the moving piston 12. The high pressure fuel therefore leaks out of the recess 8 into the increased clearances and pressurizes not only the inner surface of the recess 8 but also the whole of the wall surface of the slide bore 3, and acts to further increase the clearances of the slide sections defined above and below the annular recess 8, thereby increasing the leakage of the high pressure fuel.

The three-way electromagnetic valve 1 is assembled by integrally and fixedly connecting the solenoid 22, the valve body 2 and the control chamber 24 by fastening in order to maintain the desired pressure at which the contact surfaces of the valve body 2 and the control chamber 24. However, since the spacer 20 in the form of a ring is interposed between the solenoid 22 and the valve body 2, the fastening force acts in the direction of the outer periphery of the valve body 2 at the upper surface of the same and causes the bore edge at the opening of the slide bore 3 to be bent outward and deformed. The clearances of the slide sections between the slide bore 3 and the moving piston 12 are increased toward the bore edge of the slide bore 3, thereby increasing the leakage of the high pressure fuel.

As described above, as the clearances of the slide sections increase, the rate at which the high pressure fuel leaks out therethrough is increased, resulting in an increase in the loss of the driving torque of the pressure fuel feed pump for pressure-feeding the high pressure fluid as well as a reduction in the fuel injection pressure.

Next, a first embodiment of the present invention will be described below with reference to FIG. 1.

Figure 1:
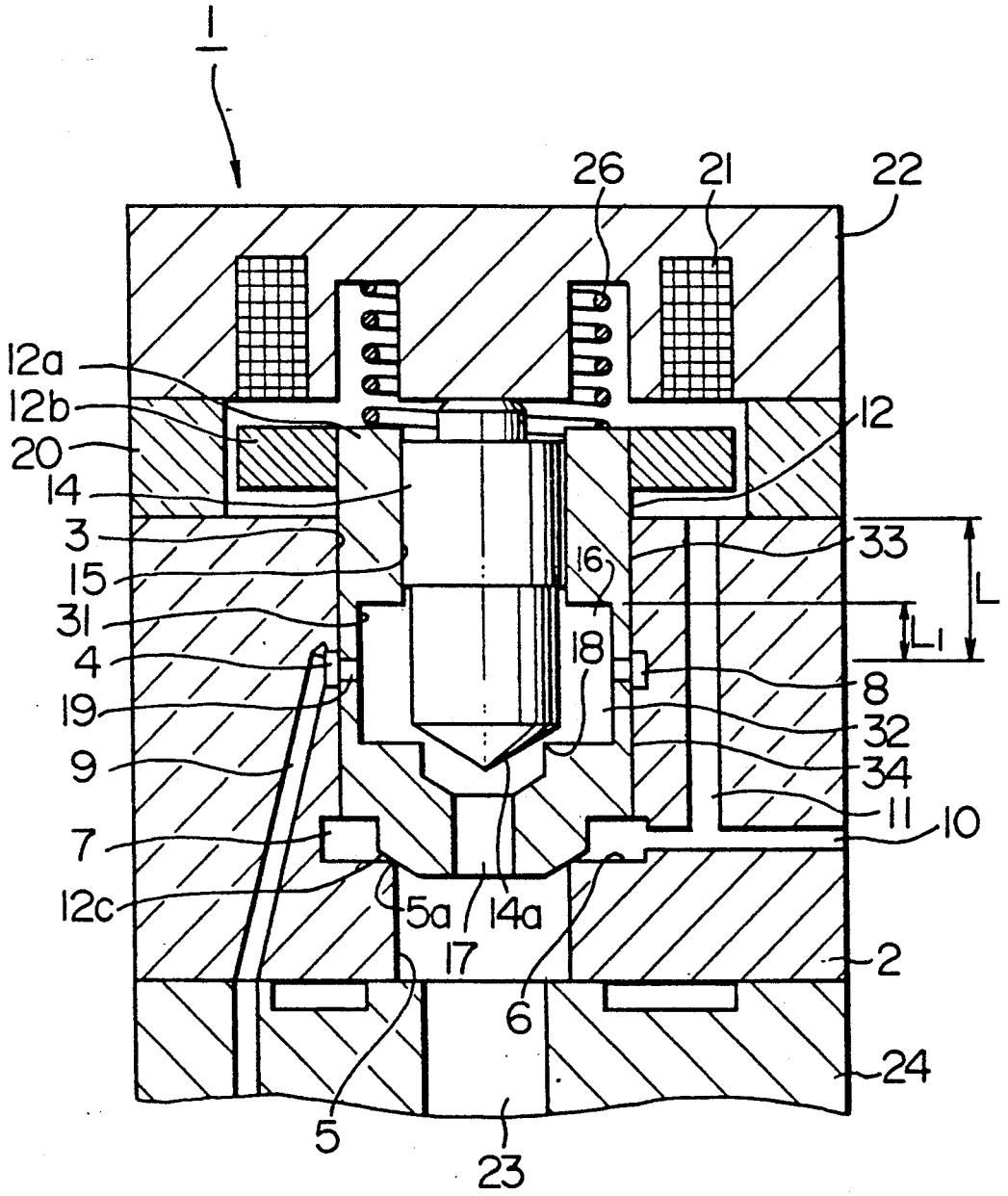
FIGS. 1 to 3 show a first embodiment of the present invention.

As shown in FIG. 1, a valve body 2 of a three-way electromagnetic valve 1 is formed of a bearing steel (SUJ2), and a slide bore 3 is formed in the valve body 2 at the center thereof. In the bore wall of the slide bore 3 are formed a supply port 4, a control port 5 which opens into the slide bore 3 in the direction of the axis thereof, and a discharge port 6 which laterally opens into the slide bore. A valve seat 5*a* is formed on an inlet portion of the control port 5. A chamber 7 is formed between the control port 5 and the discharge port 6. In the valve body 2 are also formed an annular recess 8 which communicates with the supply port 4, and an inlet passage 9 through which a high pressure fuel is introduced into the supply port 4. A discharge passage 10 is formed so as to extend from the discharge port 6. One end of a branch passage 11 branching off at the other end from the discharge passage 10 opens in an upper surface of the valve body 2.

Figure 2:
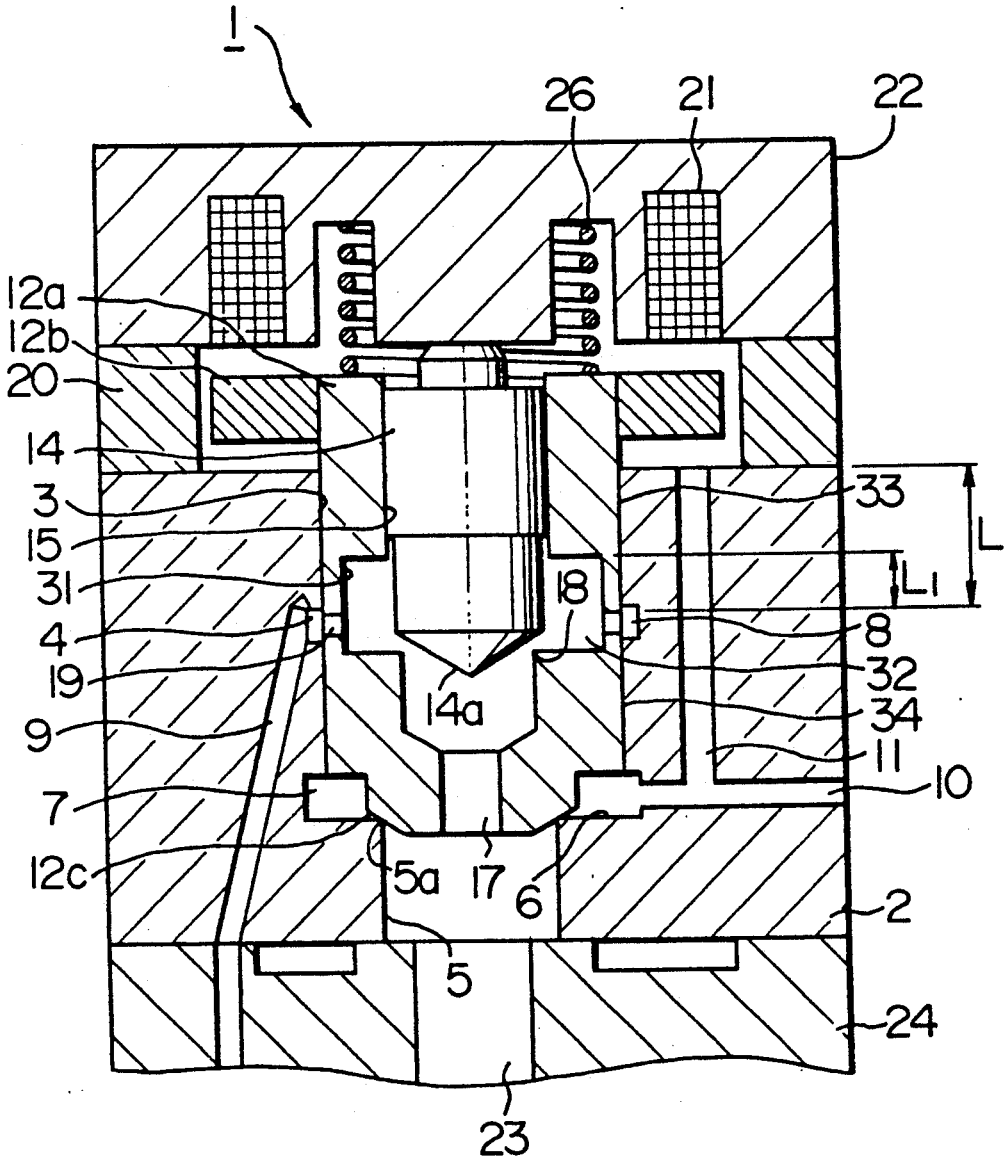

A moving piston 12 provided as a movable member is slidably disposed in the slide bore 3. The clearance between the moving piston 12 and the slide bore 3 is set to 2 to 3 μm. The moving piston 12 has a slide portion **12*a* which is formed of a cemented steel (SCM415), and a flange portion 12*b* formed of a silicon steel (3LSS) and fixed to the slide portion 12*a*. The moving piston 12 has a poppet portion 12*c* formed at its end opposite to the flange portion 12*b*. The poppet portion 12*c* can be brought into contact with and moved apart from the valve seat 5*a*. The flange portion 12*b* faces an electromagnetic coil 21. A fitting bore 15 in which a free piston 14 formed of a bearing steel (SUJ2) is fitted is formed in the moving piston 12. A chamber 16 is formed continuously with the fitting bore 15. A larger-diameter bore 31 which defines a later-mentioned a pressure accumulating chamber 32*e* is formed with the fitting bore 15. The larger-diameter bore 31 communicates with the control port 5 via an internal passage 17. A valve seat 18 is formed between the larger-diameter chamber 31 and the passage 17. A poppet portion 14*a* of the free piston 14 can be brought into contact with and moved apart from the valve seat 18. A plurality of fuel passages 19 for introducing the high pressure fuel into the increased-diameter chamber 31 are formed in the moving piston 12 while being arranged in the circumferential direction at equal angular intervals at positions corresponding to the annular recess 8 formed in the slide bore 3. The upper end of the increased-diameter chamber 31 is positioned at a distance $L_1$ from the supply port 4 which is about 20 to 40% of the distance L from the supply port 4 at which the extent of outward deformation in the radial direction of the valve body 2 caused by the high pressure fuel forcibly entering the gap between the outer peripheral surface of the free piston 14 and the slide bore 3 is zero, that is, the distance between the supply port 4 and the upper end surface of the valve body 2. The pressure accumulating chamber 32 is thus defined in which the high pressure fuel introduced from the fuel passage 19 communicating with the supply port 4 is accumulated. In the illustrated state of this embodiment, the side wall of the pressure accumulating chamber 32 symmetrically faces upper and lower slide sections 33 and 34 defined above and below the supply port 4 between the slide bore 3 and the moving piston 12. However, the pressure accumulating chamber 32 may be formed so that its side wall faces the upper slide section 33 alone, as illustrated in FIG. 2**.

The valve body 2 is integrally and fixedly connected by fastening with fastening bolts (not shown) to a solenoid 22 in which the electromagnetic coil 21 is wound and to a control chamber 24 having a passage 23 communicating with the control port 5, with a spacer 20 in the form of a ring being interposed between the solenoid 22 and the valve body 2. A spring 26 is set between the solenoid 22 and the moving piston 12 to press the poppet portion **12*c* of the moving piston 12 against the valve seat 5*a***.

The operation of three-way electromagnetic valve 1 in accordance with this embodiment is the same as the conventional type and will not be described again.

The effects of the high pressure fuel accumulated in the pressure accumulating chamber 32 shown in FIG. 1 will be described below.

Ordinarily, if an internal pressure $P_1$ and an external pressure $P_2$ is simultaneously applied to a hollow cylinder formed of thick wall and having an inside radius a and an outside radius b, the extent of deformation in the radial direction at a point of a radius r is calculated by an equation:

$$Ur = \frac{1}{E \cdot m}\left[r(m-1)(a^2P_1 - b^2P_2)/(b^2 - a^2) + (m+1)a^2b^2(P_1 - P_2)/r(b^2 - a^2)\right] \quad \text{(i)}$$

where E (modulus of elasticity)=21,000 kg/mm², and 1/m (Poisson's ratio)=0.3.

It is assumed that the pressure $P_2$ in the slide sections between the valve body 2 and the moving piston 12 is proportional to the distance from the position at which the supply port is disposed (hereinafter referred to as "central position") such that the pressure $P_2$ has a maximum value of 10 kg/mm² equal to the pressure $P_1$ of the high pressure fuel at the annular recess 8 communicating with the supply port 4 and is zero at the upper end of the upper slide section 33 and at the lower end of the lower slide section 23.

The outside radius b is set to 3.37 mm and the inside radius a is set to a value closer to that of the outside radius, i.e, to 3 mm to make the extent of deformation of the moving piston 12 due to the pressure difference (between $P_1$ and $P_2$).

On this condition, the extent of deformation $U_1$ of the moving piston 12 at a point of r=b=3.75 mm is obtained by the equation (i).

On the other hand, the extent of deformation of the valve body 2, i.e., the extent of deformation $U_2$ of the slide bore 3 is calculated by assuming that the internal pressure is $P_2$ and that only the internal pressure acts on the slide bore 3.

Figure 3:
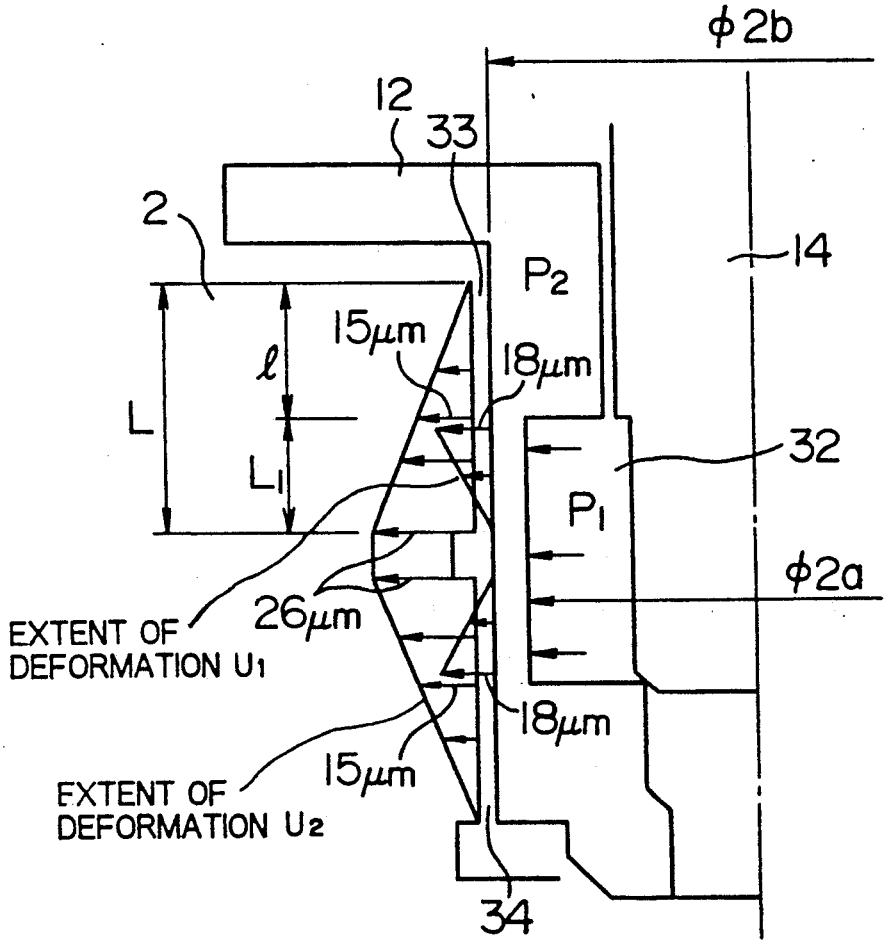

Since the pressure $P_2$ linearly decreases from the central position toward the end of each of the upper and lower slide sections 33 and 34, the extents of abovementioned deformations also change linearly according to the distance from the central position. FIG. 3 shows calculated values of these deformations.

As shown in FIG. 3, when the distance $L_1$ from the supply port 3 is $L_1$=0.4L, the extent of deformation $U_1$ of the moving piston 12 is $U_1$=1.8 μm, and the extent of deformation $U_2$ of the valve body 2 is $U_2$=1.5 μm.

Thus, the extents of these deformations are generally equal to each other and the increase in the clearance is therefore limited, thereby reducing the leakage of the high pressure fuel.

Positioning the upper end of the pressure accumulating chamber 32 at the distance $L_1$=0.4L ensures that the leakage characteristics are optimum in terms of maintenance of the clearance for sliding of the slide bore 3 and the moving piston 12, the problem of leakage of the high pressure fuel through the slide section between the fitting bore 15 and the free-piston 14 due to deformation of the moving piston 12, and so on. However, the value of the distance $L_1$ slightly varies depending upon changes in the set internal and external pressures, the slide length of the slide section between the fitting bore 15 and the free piston 14, the material of the valve body 2, the material of the moving piston 12 and so on.

In the arrangement shown in FIG. 2, the pressure accumulating chamber 32 is formed so that its side wall face the upper slide section 33 alone. This arrangement ensures that the increase in the clearance of the upper slide section 33 is limited by the effect of the pressure of the high pressure fuel accumulated in the pressure accumulating chamber 32, thereby reducing the leakage of the high pressure fuel through the slide section.

Figure 4:
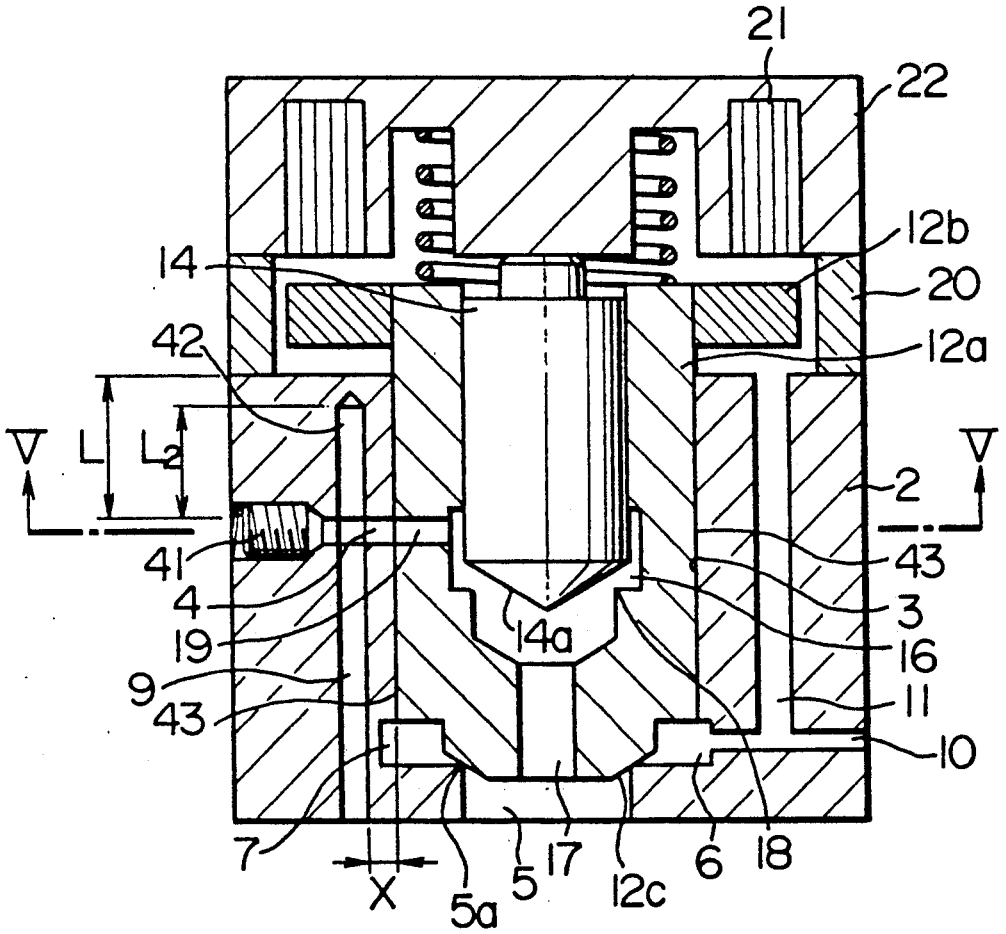
FIGS. 4 to 7 show a second embodiment of the present invention.
Figure 5:
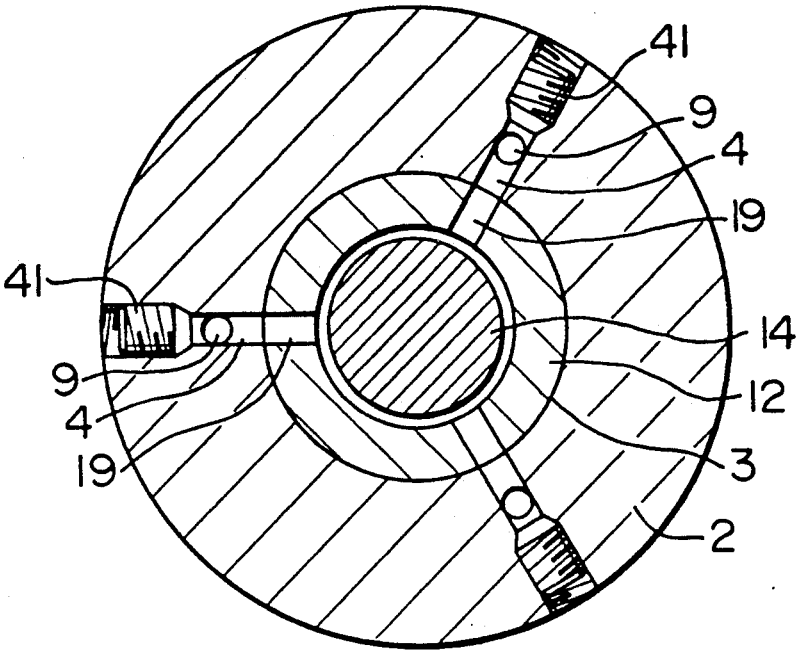
Figure 6:
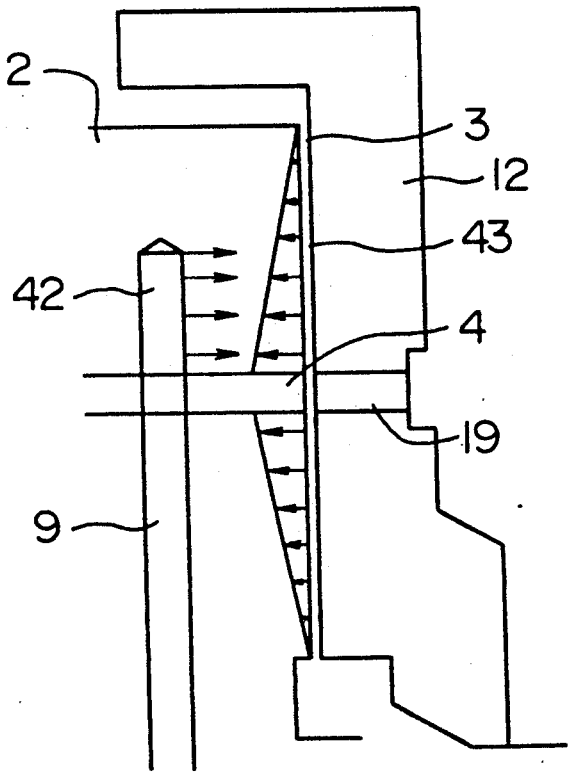

Referring next to FIG. 4, a second embodiment of the present invention is illustrated in section. Three introduction passages 9 are provided through which the high pressure fuel is introduced into supply ports 4. The introduction passages 9 are formed so as to extend parallel to the slide bore 3 formed in the valve body 2 while being arranged in the circumferential direction at equal angular intervals of 120°, as shown in FIG. 5 in transverse cross section. The supply ports 4 are bored laterally from the outside of the valve body 2 so as to be perpendicular to the introduction passages 9 and to communicate with the slide bore 3. Openings of the supply ports 4 in the valve body 2 are closed by screw plugs 41. In this embodiment, no annular recess is provided for communication with the supply port 4 while the supply ports 4 and the introduction passages 9 are disposed at three positions. Three fuel passage 19 are formed in the moving piston 12 at three positions in the circumferential direction at three positions so as to coincide with the supply ports 4, thereby enabling the high pressure fuel to be supplied to the control port 5 via a chamber 16 and the passage 17. The introduction passages 9 intersecting the supply ports 4 at right angles further extend parallel to the slide bore 3, and extension portions 42 have a length $L_2$. The pressure of the high pressure fuel introduced and accumulated in the extension portions 42 acts toward the center in the radial direction to limit the displacement ob the valve body 2 created in the opposite direction by the pressure of the high pressure fuel leaking and entering the clearance of a slide section 43 between the slide bore 3 and the moving piston 12 (refer to FIG. 6). Since no annular recess is provided, there is no possibility of the pressure of the high pressure fuel acts over the whole periphery.

Figure 7:
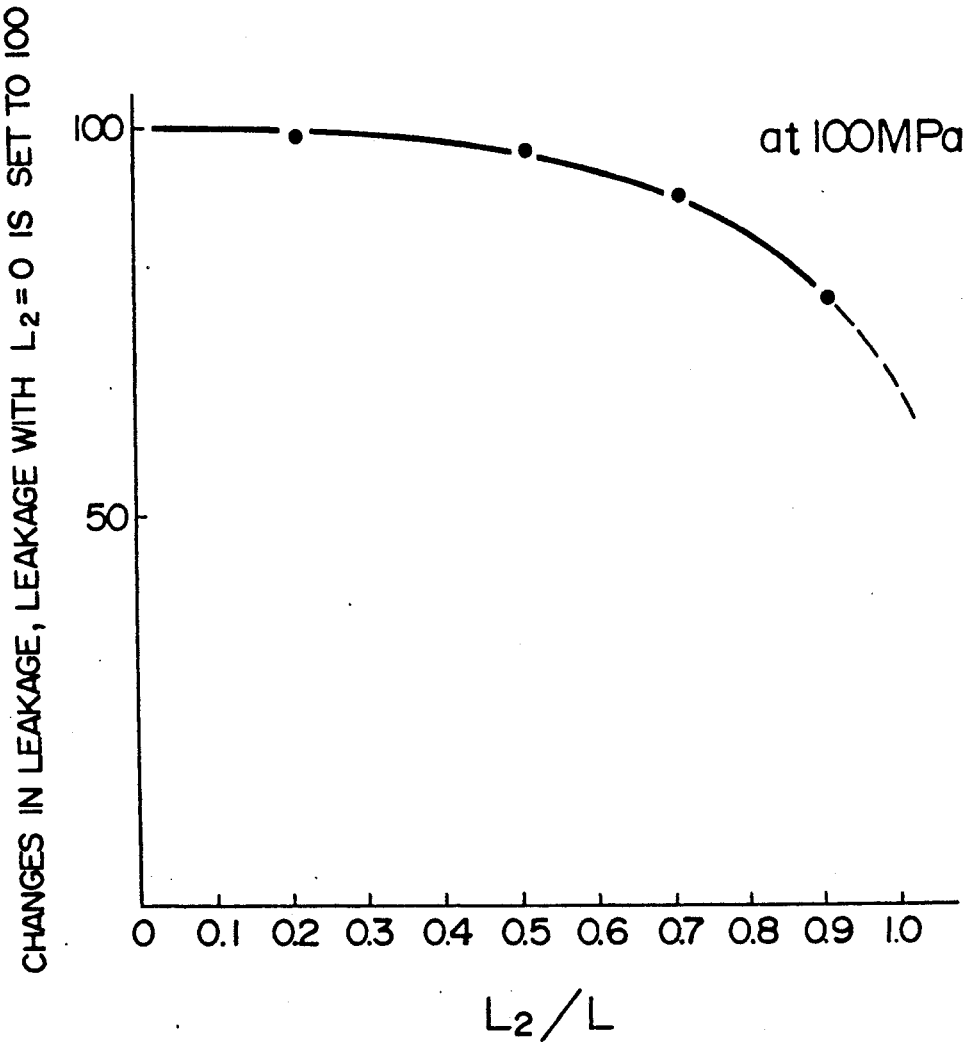

FIG. 7 shows a graph of the relationship between the ratio of the length $L_2$ of the extension portions 42 of the introduction passages 9 to the depth L to the position of the supply ports 4 and the leakage of the high pressure fuel through the slide section 43, when the inside diameter of the slide bore 3 is 10 mm, the inside diameter of each of the supply ports 4 and the introduction passages 9 is 2 mm, and the distance X between the supply ports 4 and the introduction passage 9 is 2 mm. In this case the pressure of the high pressure fuel is set to 100 Mpa and the leakage exhibited in the case where the extensions 42 are not provided is set to 100. In this graph, the tendency of reduction in the leakage can be recognized at $L_2/L=0.4$, and the is about 10% at $L_2/L=0.7$ and about 50% at $L_2/L=0.9$. It is therefore preferable to set the length $L_2$ of the extension portions 42 to a longer possible length at least not less than half the depth L to the position of the supply ports so that the extension portions is brought closer to the upper surface of the valve body 2. However, the length $L_2$ is set to about 90% of L in consideration of the pressure of the high pressure fuel, the accuracy with which the extension portions 42 are worked, and so on.

The positions in which the supply ports 4, the introduction passages 9 and the extension portions 42 are placed in association with each other is not limited to those in the described embodiment spaced apart from each other in the circumferential direction by 120°.

Figure 8:
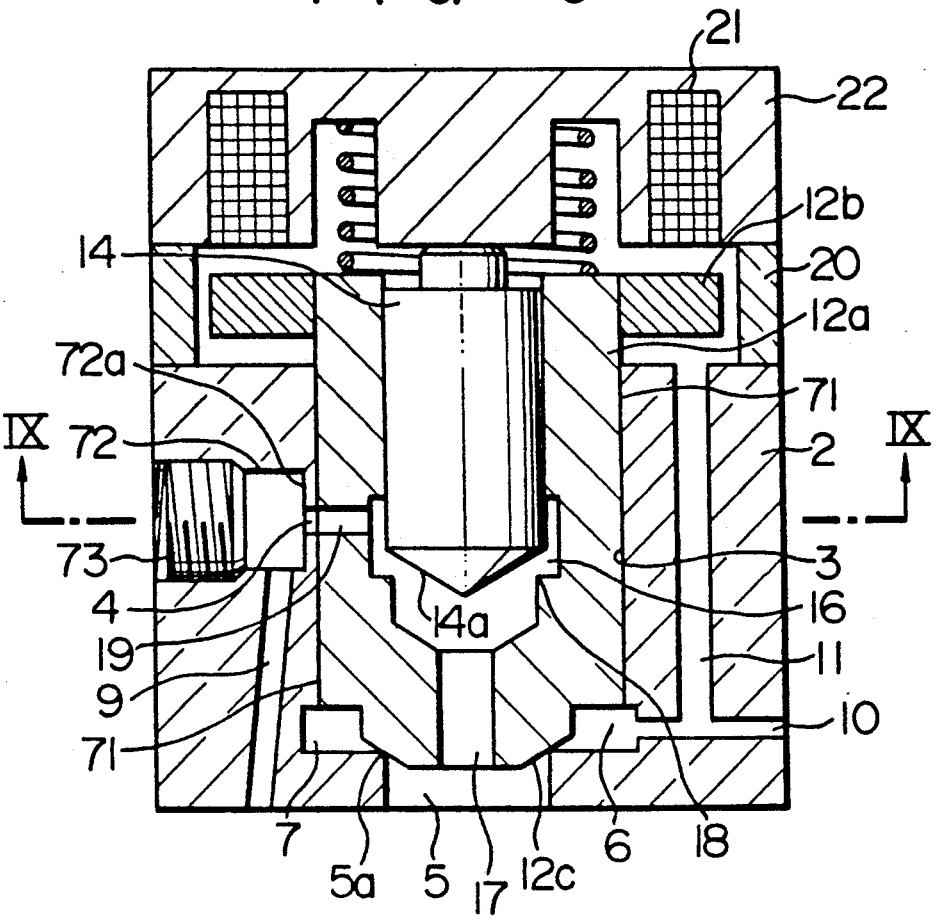
Figure 9:
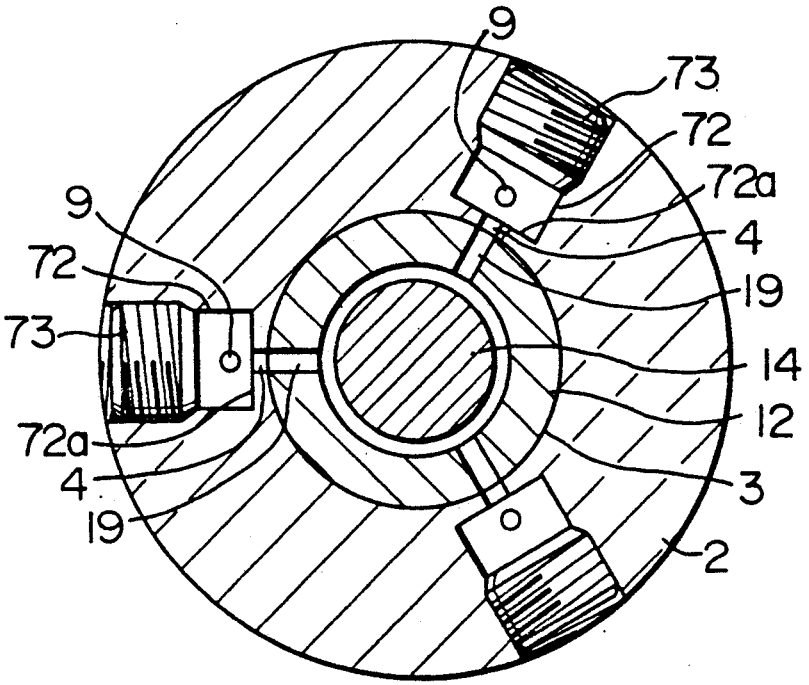

Referring to FIG. 8, a third embodiment of the present invention is illustrated in section. Three supply ports 4 are bored from the outside of the valve body 2 in the direction perpendicular to the slide bore 3 generally at the middle point of a slide section 71 defined between the slide bore 3 and the moving piston 12 so as to open into the slide bore 3. The supply ports 4 are arranged in the circumferential direction at equal angular intervals of 120°, as shown in FIG. 9 in transverse section. Pressure accumulating chambers 72 having a larger diameter are also formed in the valve body 2 with the supply ports 4. The opening of each pressure accumulating chamber 72 on the outside of the valve body 2 is closed by a screw plug 73. Introduction passages 9 through which the high pressure fuel is introduced are formed in the valve body 2 so as to respectively communicate with the pressure accumulating chamber 72, thereby enabling the high pressure fuel to be supplied to the supply ports 4 while being accumulated in the pressure accumulating chambers 72. Fuel passages 19 are formed in the moving piston 12 so as to coincide with the supply ports 4, thereby enabling the high pressure fuel to be supplied to the control port 5 via the chamber 16 and the passage 17.

The pressure of the high pressure fuel introduced and accumulated in each pressure accumulating chamber 72 acts to radially inwardly press a portion encircling the supply port 4 over the area defined as the difference between the crosssectional areas of the supply ports 4 and the pressure accumulating chambers 72, i.e., to press a larger-diameter step portion 72*a*.

Figure 10B:
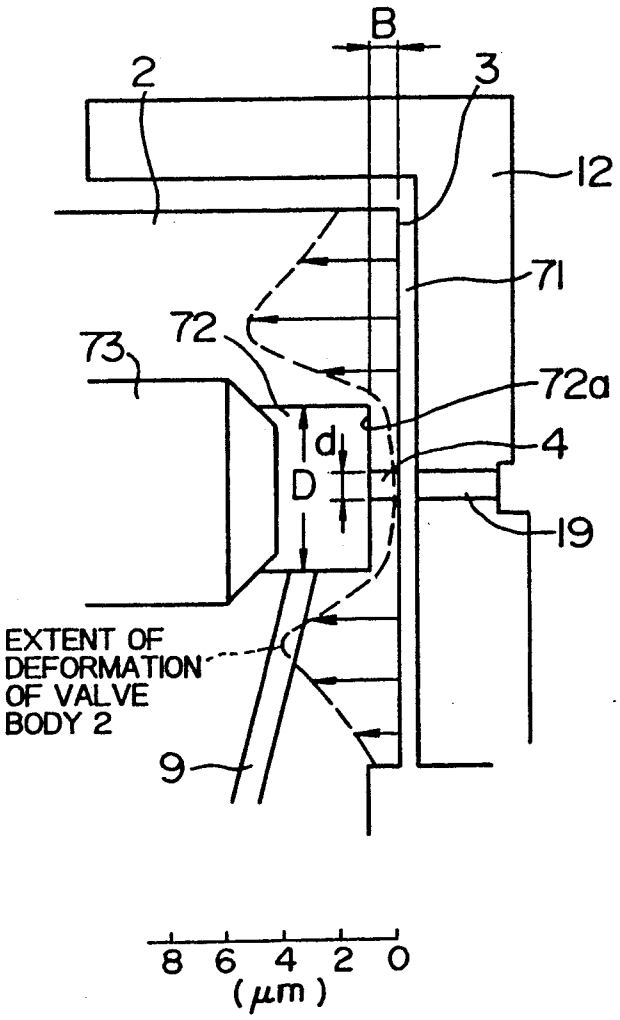
Figure 10A:
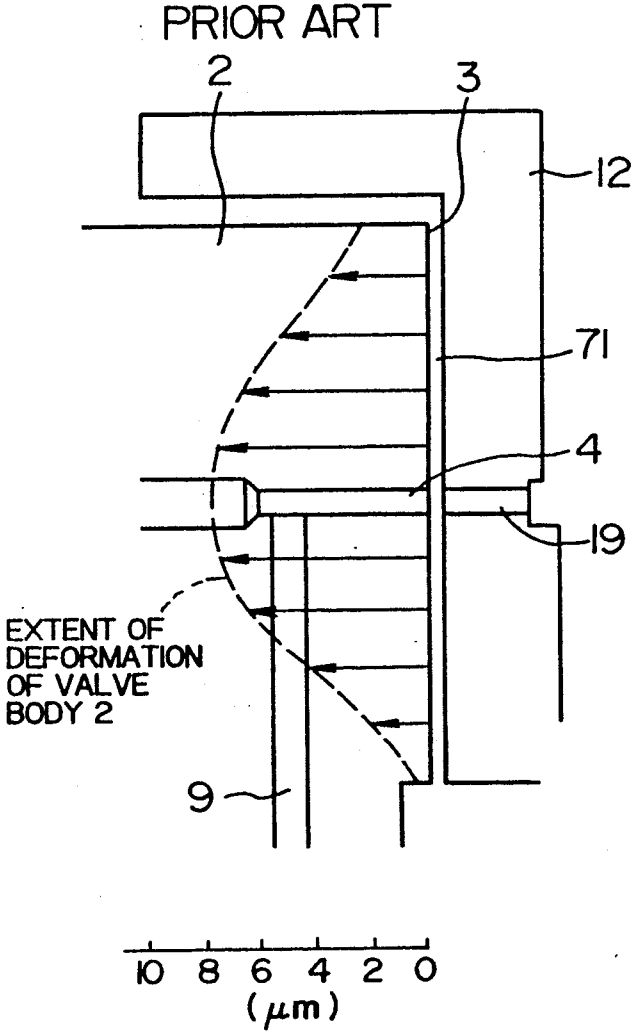
FIG. 10A PRIOR ART

In each of FIGS. 10A and 10B, the extent of outward deformation of the valve body 2 is indicated with a broken line which deformation is caused by the pressure of the high pressure fuel leaking out of the supply port 4 into the clearance of the slide section 71 between the slide bore 3 formed in the valve body 2 and the moving piston 12. FIG. 10A relates to a case of the conventional arrangement where the pressure accumulating chamber 72 is not provided, and FIG. 11B relates to a case where the pressure accumulating chamber 72 is provided. The pressure of the high pressure fuel is set to 300 MPa. In the construction of FIG. 10B, the position B at which the larger-diameter step portion 72*a* of the pressure accumulating chamber 72 is formed is at a distance of 1 mm from the slide bore 3, and the ratio D/d of the inside diameter D of the pressure accumulating chamber 72 to the inside diameter of the supply port 4 is 5

As a result of the provision of the pressure accumulating chamber 72, in the construction of FIG. 10B, the extent of deformation of the portion of the wall of the slide bore 3 corresponding to the larger-diameter portion 72*a* of the pressure accumulating chamber 72 is limited to approximately zero. Accordingly, this embodiment is substantially free from the problem of any increase in the clearance of the slide section 71 caused by the pressure of the high pressure fluid leaking out of the supply port 4 into the clearance of the slide section 71 as in the case of the conventional valve and, hence, the problem any increase in the leakage of the high pressure fuel, thus achieving a remarkable reduction in the leakage of the high pressure fuel.

The ratio of the inside diameter D of the pressure accumulating chamber 72 and the inside diameter d of the supply port 4 is not limited to the above-mentioned value, and the positions of the supply ports 4, the introduction passages 9 and the pressure accumulating chambers 72 are not limited to those mentioned above.

Figure 11:
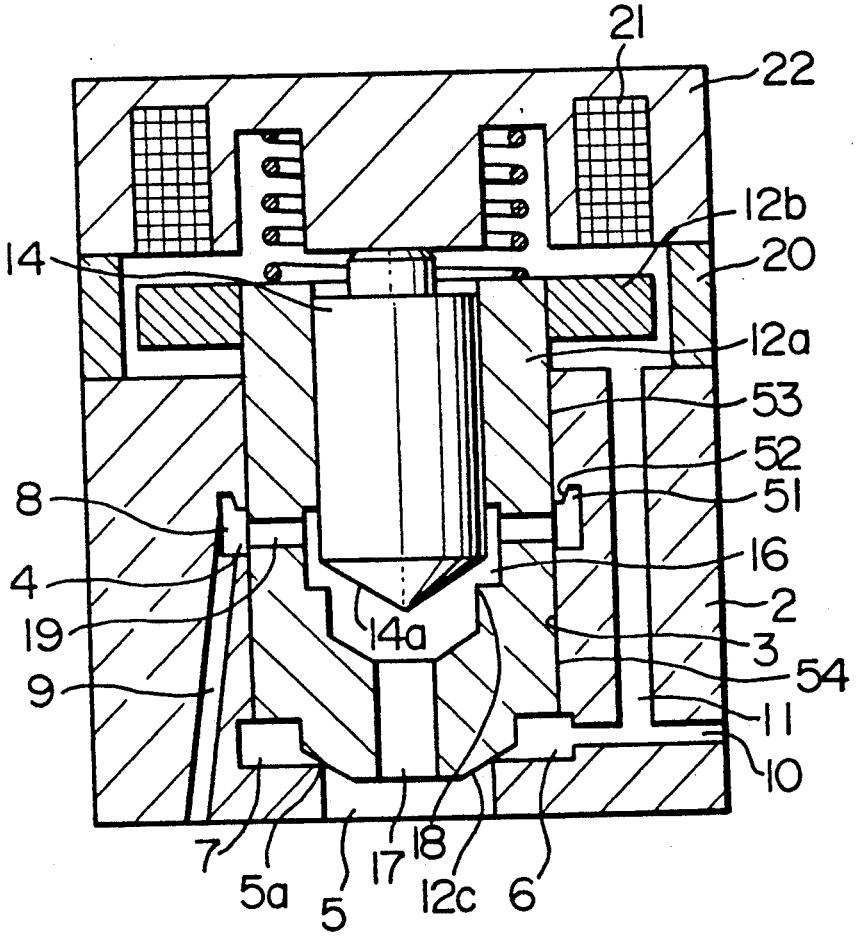
Figure 12:
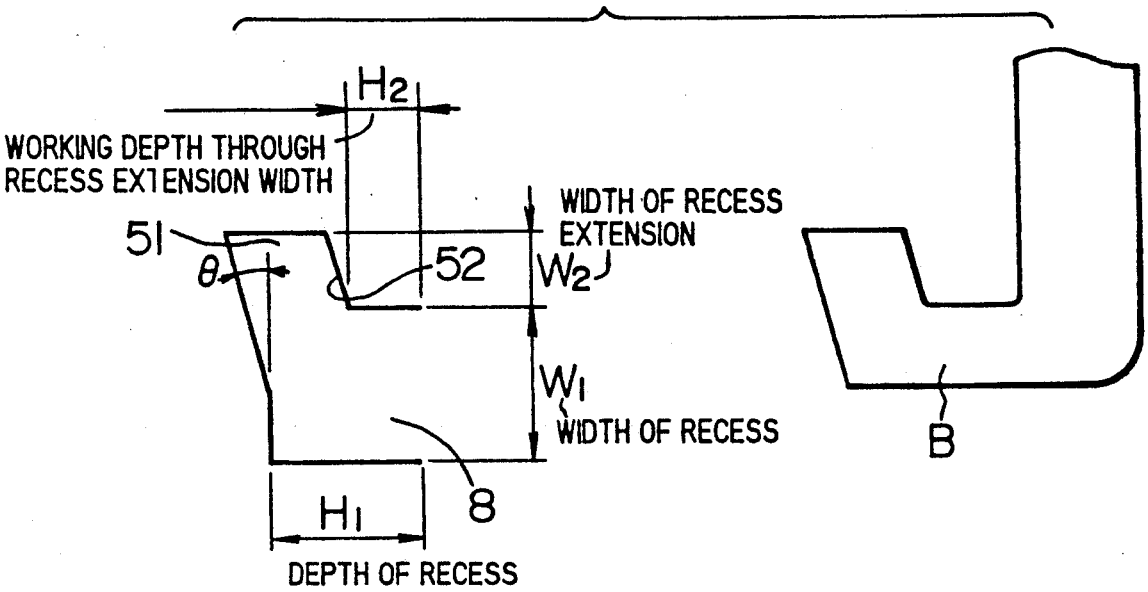
Figure 13:
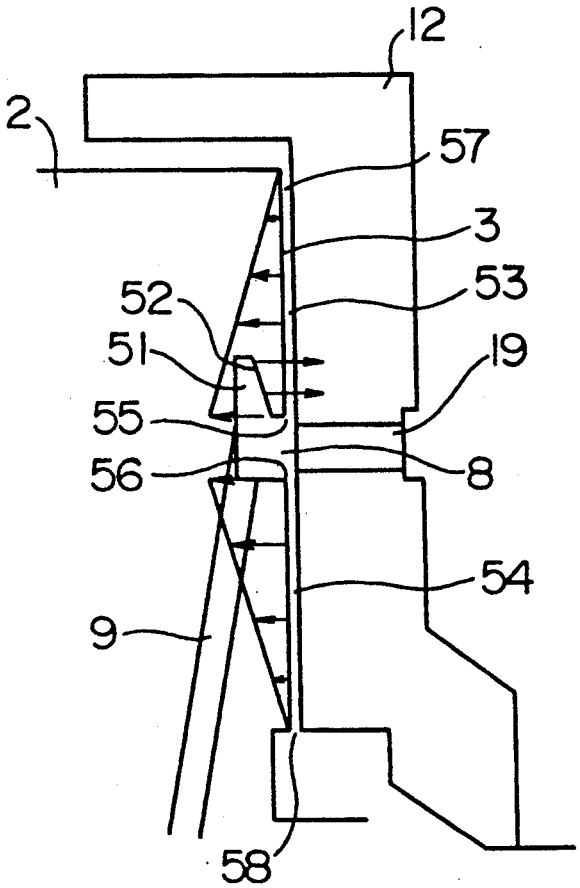

Referring to FIG. 11, a fourth embodiment of the present invention is illustrated in section. An annular extension 51 is formed in the annular recess 8 by partially extending the same upward in the widthwise direction thereof. If as shown in FIG. 12 the width and the depth of the recess 8 are $W_1$ and $H_1$, respectively, the width of the extension is $W_2=W_1/2$, and the depth at which the recess wall is worked to form the extension is $H_2=H_1/2$. The extension 51 is inclined at an angle $\theta$ of 15°. Working for forming the extension 51 is effected by using a special bit B such as that shown in FIG. 12. The pressure of the high pressure fuel introduced and accumulated in the extension 51 acts toward the center of the valve in the radial direction by the effect of a pressure receiving wall 52 so that this inward pressure acts to limit the outward deformation of the valve body 2 against the pressure of the high pressure fuel leaking and entering into the clearance of an upper slide section 53 between the slide bore 3 and the moving piston 12 (refer to FIGS. 1 and 3).

Figure 14:
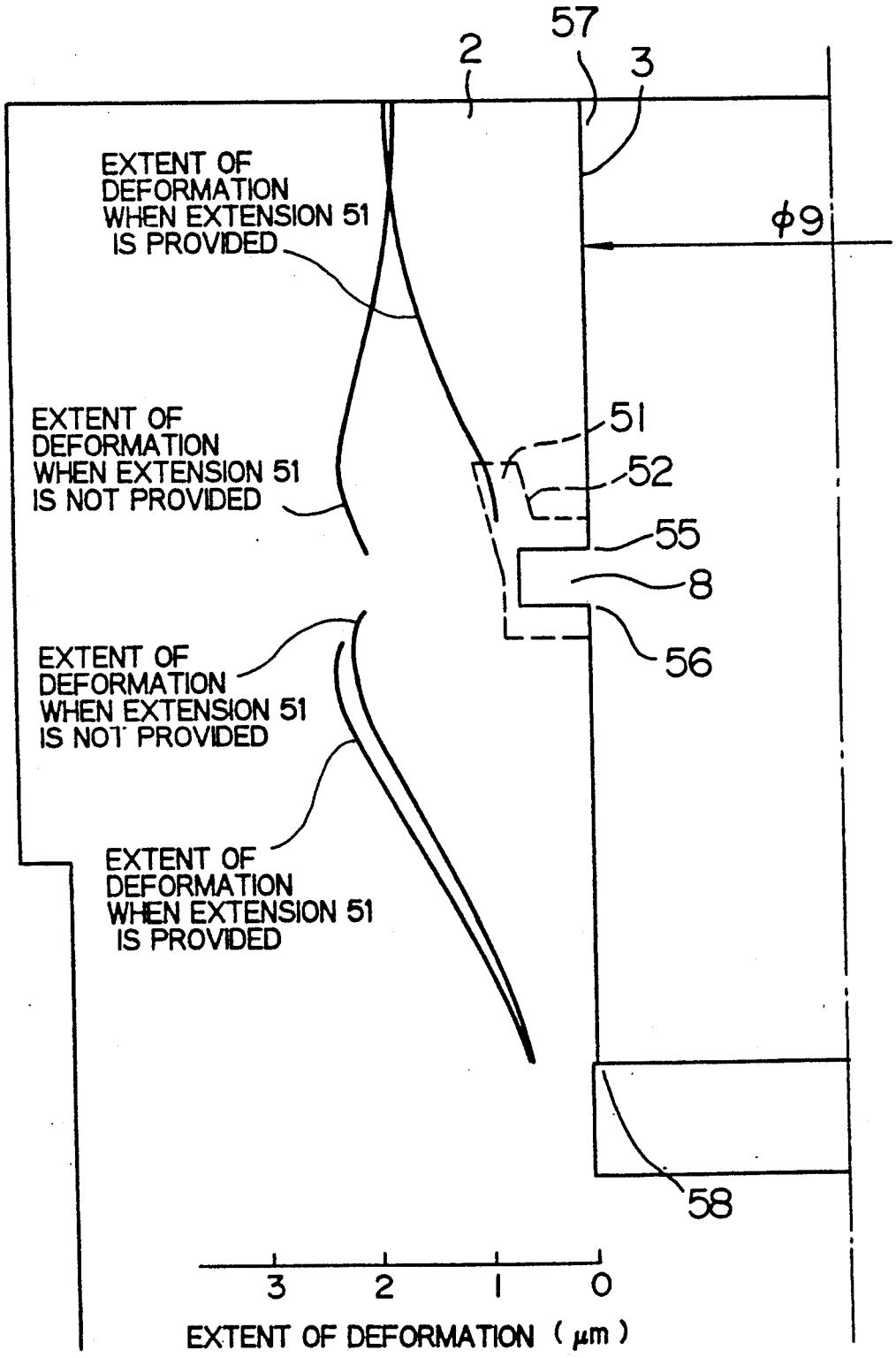
Figures 15A, 15B, 15C, 15D:
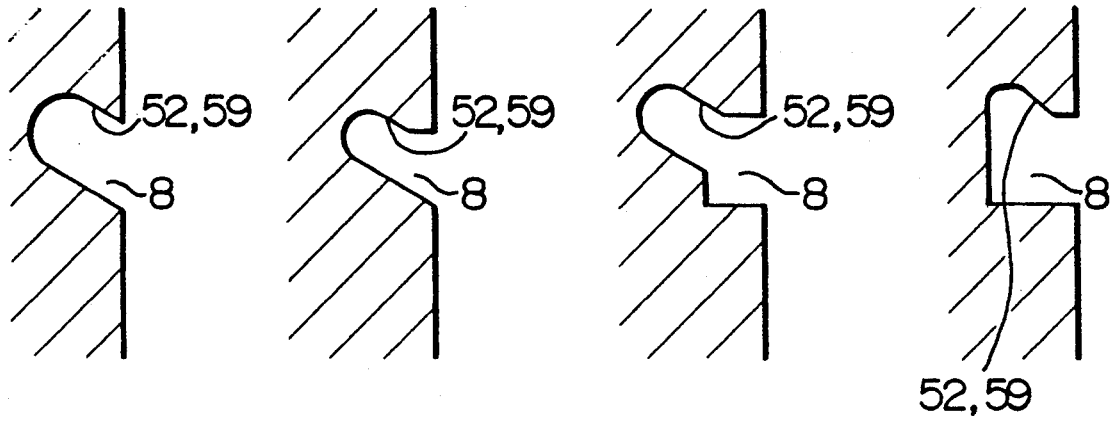
FIG. 15A is a cross-sectional view illustrating an example of the recess shape.
FIGS. 15B to 15D are cross-sectional views illustrating other examples of the recess shape.

FIG. 14 shows the comparison between the extent of deformation in a case where the shape of the recess 8 is determined by the width $W_1=2$ mm, the extension width $W_2=1$ mm, the recess depth $H_1=2$ mm and the recess extension width $H_2=1$ mm, the inside diameter of the slide bore is 9 mm, and the internal pressure is 100 MPa and the extent of deformation in the case where the extension 51 is not provided.

As can be understood from FIG. 14, the extent of outward deformation of the valve body 2 is reduced by about 1.5 μm at the extension 51.

Values of the extents of deformations of the upper and lower slide sections 53 and 54 and the resulting leakage obtained by measurements are shown below in Table 1.

TABLE 1

| | | Inlet deformation μm | Outlet deformation μm | Leakage cc/min. | Total leakage cc/min. |
|---|---|---|---|---|---|
| No extension is provided | Upper Slide section | 3.7 | 3.2 | 70.5 | 107.9 |
| | Lower slide section | 3.6 | 2.1 | 37.4 | 107.9 |
| Extension is provided | Upper slide section | 2.3 | 3.3 | 37.1 | 90.8 |
| | Lower slide section | 3.8 | 2.2 | 43.7 | 90.8 |

As shown in Table 1, in the case where the extension 51 is provided, the extent of deformation at an inlet 55 communicating with the annular recess 8 is limited to a value smaller than that in the case where the extension 51 not provided by about 1.4 μm; the leakage through the upper slide section 53 which occupies 70% of the total leakage is reduced from 71 cc/min. to 37 cc/min by the provision of the extension 51, which reduction is remarkable. In this case, the extent of deformation at an inlet of the lower slide section 54 slightly increases and the leakage through the slide section 54 correspondingly increases, but on the whole the total leakage is reduced from 108 cc/min. to 91 cc/min. by about 16%. The extent of deformation does not change substantially at an outlet 57 of the upper slide section 57 or at an outlet 58 of the lower slide section 54 even through the extension 51 is provided.

As can be understood from these results, if the annular recess 8 is formed with the extension 51 to form the pressure receiving wall 52 on which the high pressure fuel accumulated in the extension 51 acts toward the center of the valve in the radial direction, the extent of outward deformation at the inlet of the corresponding slide section communicating with the annular recess 8 can be limited. Consequently, the leakage of the high pressure fuel through the upper slide section 53 can be reduced by forming in the annular recess 8 a slant wall 59 which extends from the innermost part of the recess 8 toward the opening of the same and which serves as the pressure receiving wall 52 is formed. The shape of the recess 8 may be selected from type various types such as those shown in FIGS. 15A to 15D.

Needless to say, two extensions 51 or slant walls 59 may be formed in the upper and lower walls of the annular recess 8 in order to limit the leakage through the lower slide section 54 as well as the leakage through the upper slide section 53.

Figure 16:
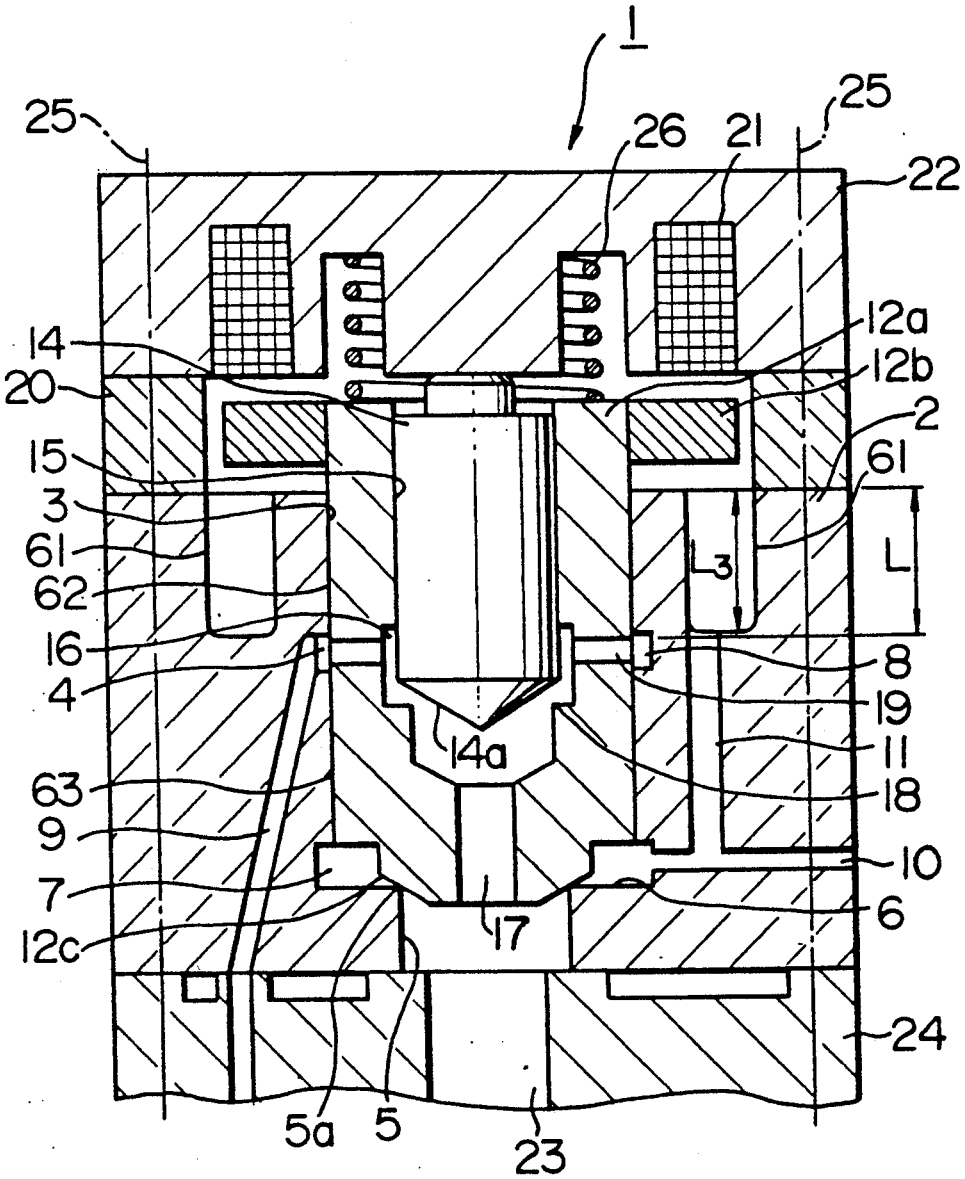

Referring then to FIG. 16, a fifth embodiment of the present invention is illustrated in section. The valve body 2 is integrally and fixedly connected by fastening with fastening bolts 25 to the solenoid 22 and to the control chamber 24 having a passage 23 communicating with the control port 5, with a spacer 20 in the form of a ring being interposed between the solenoid 22 and the valve body 2. An annular groove 61 is formed in the upper surface of the valve body 2 on the outside of the slide bore 3. The annular groove serves to interrupt, when the valve body is fastened in this manner, transmission of the fastening force acting toward the outer periphery of the valve body 2 and to thereby prevent an upper slide section 62 of the slide bore 3 at an upper portion of the valve body 2 from being displaced outward.

The leakage $Q_L$ through the slide section is calculated by $$Q_L=k\cdot\epsilon_1^2\cdot\epsilon_2^2/(\epsilon_1+\epsilon_2)$$

where $\epsilon_1$: a clearance at the slide section inlet, $\epsilon_2$: a clearance at the slide section outlet, and k: a constant determined by the internal pressure, the passage length, the inside diameter and the viscosity coefficient.

Figure 17:
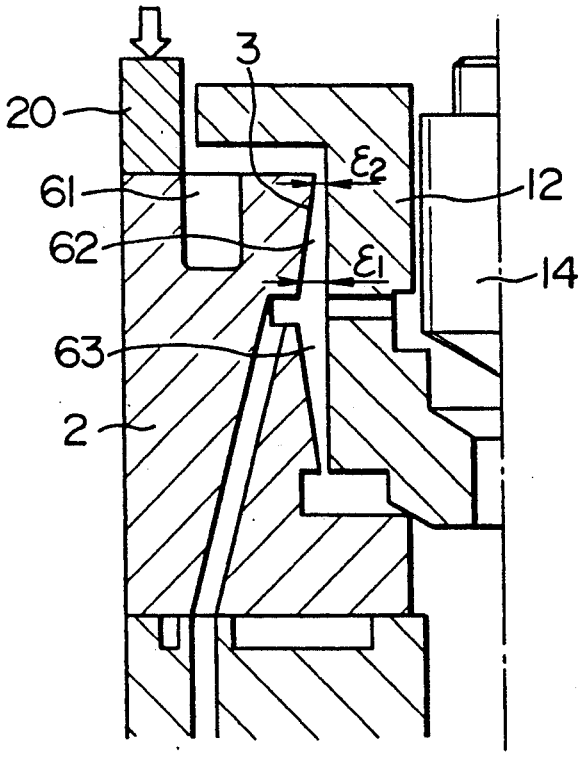

$Q_L$ is therefore maximized when $\epsilon_1=\epsilon_2$ and can be reduced by making $\epsilon_2$ smaller than $\epsilon_1$ (refer to FIG. 17).

Figure 18:
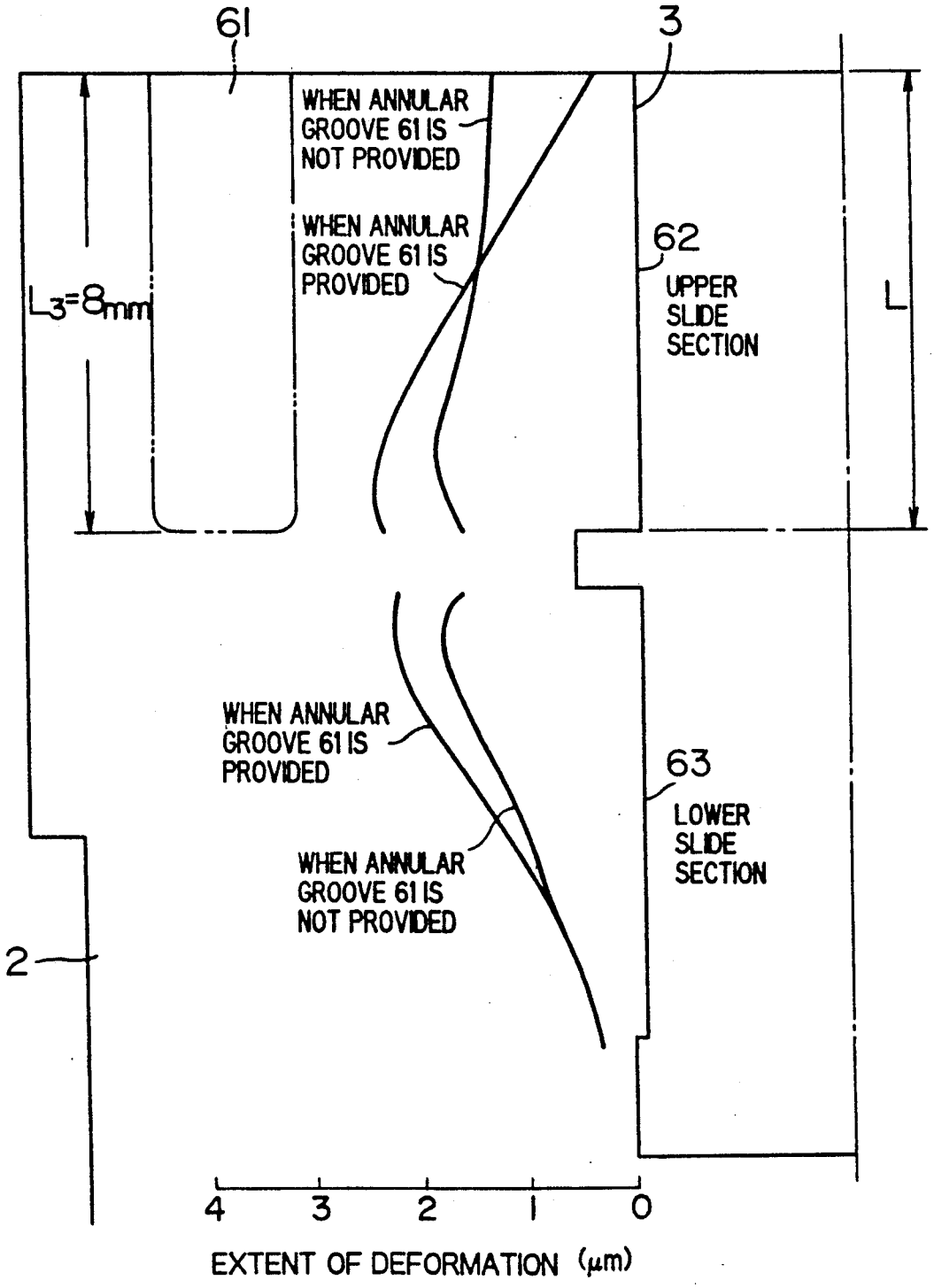

FIG. 18 shows the results of measurements of the extents of deformations of the upper section 52 and a lower section 63 conducted as described below. The valve body 2 is provided in which the inside diameter of the slide bore 3 is 7.5 mm, both the lengths of the upper slide section 62 and the lower slide section 63 with the annular recess 8 interposed therebetween are 8 mm, and the depth of the annular groove 61 is 8 mm. The bottom of the valve body 2 is fixed, and a fastening load of 8.6 $kg/mm^2$ is applied to an outer peripheral portion of the upper end surface of the valve body while an internal pressure of 10 $kg/mm^2$ is applied. FIG. 18 also shows the extents of deformations in the case where no annular groove is provided in the upper surface of the valve body 2.

As can be understood from FIG. 18, the outward displacement of the upper half of the upper slide section 62 is effectively limited; the displacement of the slide bore edge is smaller than that in the case where no annular groove is provided by about 1 mm, and the clearance $\epsilon_2$ at the slide section outlet in the equation for calculation the leakage is correspondingly smaller, resulting in a reduction in the leakage through each slide section.

Figure 19:
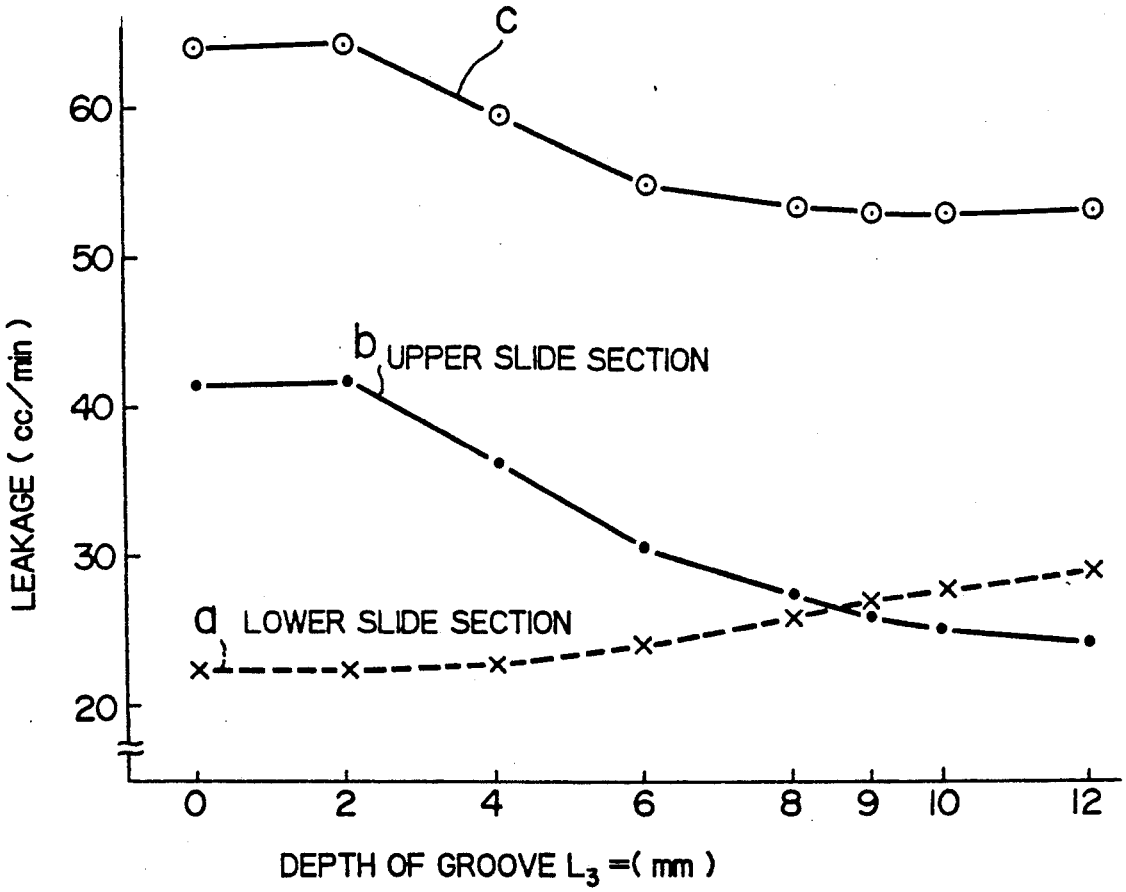

FIG. 19 shows the relationship between the depth $L_3$ (mm) of the annular recess 61 and the leakages (cc/min.) of the high pressure fuel through the slide sections in the valve body 2 specified above. In FIG. 19, a line a indicates changes in the leakage through the lower slide section, a line b indicates changes in the leakage through the upper slide section, and a line c indicates the sum of these leakages. As shown in FIG. 19, when the groove depth $L_2=8$ mm, i.e., it is equal to the length of the upper and lower slide sections 62 and 63, the leakage is minimized, i.e., it is reduced by 15% from the leakage in the case where no annular groove is provided. Even if the depth of the annular groove is further increased, the leakage is not reduced although it maintained at the minimum level. This is because when the depth of the annular groove exceeds the length (depth) of the upper slide section 62, the leakage through the lower slide section 63 increases and cancels out the reduction in the leakage through the upper slide section 62.

In this embodiment, the minimum value of the leakage is obtained, i.e., the optimum leakage characteristics are exhibited when the depth $L_3$ is equal to the length of the upper slide section 62. However, the above values slightly vary by changes in the measurement conditions, e.g., the internal pressure and the viscosity.

The phenomenon of increase in the leakage based on the increase in the clearance of the slide section between the slide bore 3 of the valve body 2 and the moving piston 12 caused by the pressure of the high pressure fuel leaking and entering this clearance is different from the phenomenon of increase in the leakage based on the increase in the clearance of the slide section caused by the fastening force. The fifth embodiment can therefore be combined with each of the first to fourth embodiments to cope with problem of increase in the leakage in respective cases, thereby enabling the leakage to be further reduced.

In accordance with the present invention, as described above, gaps formed between the slide bore and the outer peripheral surface of the movable member can be reduced by the reduction means. It is thereby possible to reduce the leakage and, hence, to effect fluid control with improved accuracy.

What is claimed is:

1. A three-way electromagnetic valve comprising:

a valve body having a supply port through which a pressurized fluid flows, a control port, a discharge port, a slide bore formed with said ports so as to communicate with the same, and a valve seat formed between said supply port and said discharge port;

a movable member slidably disposed in said slide bore and capable of contacting and moving away from said valve seat, said movable member having an internal passage formed in its body to enable said supply port and said control port to communicate with each other, said movable member providing communication between said control port and said discharge port when not seated on said valve seat;

an actuator for driving said movable member;

opening-closing means disposed in said internal passage of said movable member, operated to open said internal passage when said movable member is seated on said valve seat and operated to close said internal passage when said movable member is not seated on said valve seat; and reduction means for reducing a gap formed between said slide bore and the outer peripheral surface of said movable member when said movable member is seated on said valve seat.

2. A three-way electromagnetic valve according to claim 1, wherein said gap formed between said slide bore and the outer peripheral surface of said movable member is created by penetration of the pressurized fluid between said slide bore and said movable member.

3. A three-way electromagnetic valve according to claim 2, wherein said reduction means includes a pressure accumulating chamber formed in said movable member to enable the pressurized fluid to deform said movable member by pressing the same outward in a radial direction from the interior thereof.

4. A three-way electromagnetic valve according to claim 3, wherein said pressure accumulating chamber is a larger-diameter chamber formed in said internal passage of said movable member so as to extend in diametral directions.

5. A three-way electromagnetic valve according to claim 4, wherein the distance between said supply port and an end of said pressure accumulating chamber is set so that the extent of radially outward deformation of said movable member caused by the pressurized fluid in said pressure accumulating chamber is generally equal to the extent of radially outward deformation of said valve body caused by penetration of the pressurized fluid between said slide bore and the outer peripheral surface of said movable member.

6. A three-way electromagnetic valve according to claim 4, wherein the distance $L_1$ between said supply port and an end of said pressure accumulating chamber is about 20 to 40% of the distance L between said supply port and a point at which the extent of radially outward deformation of said movable member caused by the pressurized fluid entering between said slide bore and the outer peripheral surface of said movable member is zero.

7. A three-way electromagnetic valve according to claim 3, wherein the distance between said supply port and an end of said pressure accumulating chamber is set so that the extent of radially outward deformation of said movable member caused by the pressurized fluid in said pressure accumulating chamber is generally equal to the extent of radially outward deformation of said valve body caused by penetration of the pressurized fluid between said slide bore and the outer peripheral surface of said movable member.

8. A three-way electromagnetic valve according to claim 2, wherein said reduction means includes a pressure accumulating chamber formed in said valve body to enable the pressurized fluid to deform said valve body by pressing the same toward said slide bore.

9. A three-way electromagnetic valve according to claim 8, wherein said pressure accumulating chamber is a high pressure fluid passage formed in said valve body along a slide section between said slide bore and said movable member in the axial direction, a high pressure fuel being supplied through said high pressure fluid passage.

10. A three-way electromagnetic valve according to claim 9, wherein a plurality of supply ports are formed in said valve body, and a plurality of fuel passages facing said supply ports are formed in said movable member as part of said internal passage so as to extend in radial directions.

11. A three-way electromagnetic valve according to claim 10, wherein the distance $L_2$ between said supply port and an end of said high pressure fluid passage end of said pressure accumulating chamber is not smaller than about 50% of the distance L between said supply port and a point at which the extent of radially outward deformation of said movable member caused by the high pressure fluid entering between said slide bore and the outer peripheral surface of said movable member is zero.

12. A three-way electromagnetic valve according to claim 11, wherein the distance $L_2$ between said supply port and an end of said high pressure fluid passage end of said pressure accumulating chamber is not larger than about 90% of the distance L between said supply port and a point at which the extent of radially outward deformation of said movable member caused by the high pressure fluid entering between said slide bore and the outer peripheral surface of said movable member is zero.

13. A three-way electromagnetic valve according to claim 8, wherein said pressure accumulating chamber is formed so as to communicate with said supply port.

14. A three-way electromagnetic valve according to claim 13, wherein a plurality of supply ports are formed in said valve body, and a plurality of pressure accumulating chambers are formed so as to face said supply ports in radial directions.

15. A three-way electromagnetic valve according to claim 14, wherein the diameter D of said pressure accumulating chamber is about 5 times larger than the diameter d of said supply port.

16. A three-way electromagnetic valve according to claim 8, wherein said pressure accumulating chamber is a cut groove recessed in the axial direction and communicating with said supply port.

17. A three-way electromagnetic valve according to claim 1, wherein an outer peripheral portion of an upper surface of said valve body is integrally fixed to said actuator by being fastened thereto, and this fastening creates a gap between said slide bore and the outer peripheral surface of said movable member.

18. A three-way electromagnetic valve according to claim 17, wherein said reduction means includes an annular groove formed around said slide bore.

19. A three-way electromagnetic valve according to claim 18, wherein the depth $L_3$ of said annular groove from the upper surface of said valve body is about 30 to 100% of the distance L between the upper surface of said valve body and said supply port.

20. A three-way electromagnetic valve comprising:

a valve body having a supply port through which a pressurized fluid flows, a control port, a discharge port, a slide bore formed with said ports so as to communicate with the same, and a valve seat formed between said supply port and said discharge port;

a movable member slidably disposed in said slide bore and capable of contacting and moving away from said valve seat, said movable member having an internal passage formed in its body to enable said supply port and said control port to communicate with each other, said movable member providing communication between said control port and said discharge port when not seated on said valve seat;

an actuator for driving said movable member;

opening-closing means disposed in said internal passage of said movable member, operated to open said internal passage when said movable member is seated on said valve seat and operated to close said internal passage when said movable member is not seated on said valve seat; and pressure accumulation chamber means for maintaining part of the pressurized fluid for balancing with pressure deformation caused by penetration of the pressurized fluid between said slide bore and the outer peripheral surface of said movable member when said movable member is seated on said valve seat.

21. A three-way electromagnetic valve according to claim 20, wherein said pressure accumulation chamber means is formed in said movable member.

22. A three-way electromagnetic valve according to claim 20, wherein said pressure accumulation chamber means is formed in said valve body.

23. A three-way electromagnetic valve according to claim 20, wherein said pressure accumulation chamber means includes a plurality of fluid passages.

* * * * *